United States Patent [19]

Schuhmann

[11] 4,311,066

[45] Jan. 19, 1982

[54] REDUCTION GEAR AND SPEED CONTROL FOR DREDGE PUMPS

[75] Inventor: Bernd Schuhmann, Dortmund, Fed. Rep. of Germany

[73] Assignee: Mannesmann Aktiengesellschaft, Duesseldorf, Fed. Rep. of Germany

[21] Appl. No.: 105,896

[22] Filed: Dec. 21, 1979

[30] Foreign Application Priority Data

Jan. 12, 1979 [DE] Fed. Rep. of Germany ..... 2901560

[51] Int. Cl.[3] ..... F16H 47/04

[52] U.S. Cl. ..... 74/687; 74/752 C; 74/752 E

[58] Field of Search ..... 74/687, 752 C, 752 E, 74/688

[56] References Cited

U.S. PATENT DOCUMENTS

| | | | |
|---|---|---|---|
| 3,427,899 | 2/1969 | Gunderson et al. | 74/687 |
| 3,714,846 | 2/1973 | Louis et al. | 74/687 |
| 3,744,344 | 7/1973 | Olsen et al. | 74/687 |
| 3,796,111 | 3/1974 | Schauer | 74/687 |
| 3,969,958 | 7/1976 | Miyao et al. | 74/687 |
| 4,019,404 | 4/1977 | Schauer | 74/687 |

*Primary Examiner*—George H. Krizmanich

*Attorney, Agent, or Firm*—Smyth, Pavitt, Siegemund & Martella

[57] ABSTRACT

A high-speed drive shaft is connected to dredge pump shaft by a planetary gear, upon which a controlled speed is superposed, by branching power off the high-speed shaft for driving an auxiliary adjustable pump which, in turn, runs a hydrostatic motor whose rotary output is connected to the ring gear of the planetary gear via a transmission which includes two brakes and a speed-responsive clutch; one brake is also speed-responsive, the other one is responsive to motor pressure, to provide a possibly redundant system for preventing torque transmission to the motor, e.g., in case of dredge pump blockage.

7 Claims, 1 Drawing Figure

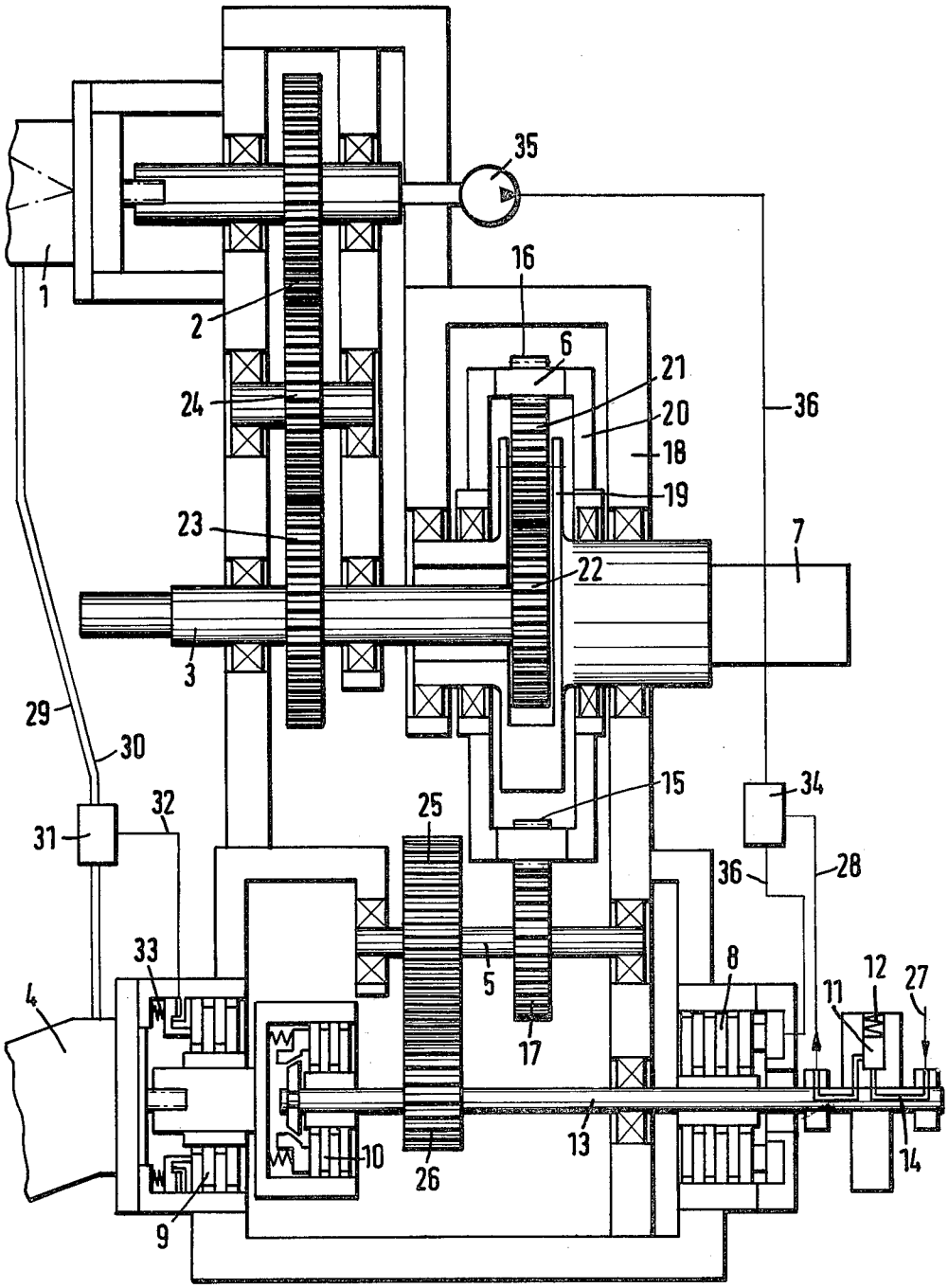
35
16
1
2
6
21
24
20
36
18
19
23
7
22
3
29
30
15
34
32
25
31
36
28
33
8
12
27
4
5
11
17
13
14
10
26
9

REDUCTION GEAR AND SPEED CONTROL FOR DREDGE PUMPS

BACKGROUND OF THE INVENTION

The present invention relates to a reducing gear; and more particularly, the invention relates to a planetary reducing-type gear interposed between a drive shaft and the input shaft for a dredge pump.

Generally speaking, dredge pumps must be run at different rpm numbers for different phases of operation. For example, during suction, one needs to change the rotational speed of the pump, whenever the soil consistency encountered and its density varies. Removal of the pumped sludge requires still other speeds. The mode change from suction to pumping by means of the same pump is carried out through valves, i.e., switching of valve flaps or the like.

The several switching states, as far as the valves are concerned, are usually associated with particular gear ratios to be changed only when the pump is at rest. Prior to shifting gears, one usually has to empty the suction and pressure lines so that the sludge will not dry and cake to the pipes during the mode change.

Other pumps are known, in which the rotational speed is steplessly, i.e., steadily, adjusted via directly controlled hydrostatic drives, or by means of electric control, or through slip friction clutches. Even though these steady speed control systems do not require stopping the pump for any speed and operational changes, all of these controls are disadvantaged by significant losses in power, up to 20%.

DESCRIPTION OF THE INVENTION

It is an object of the present invention to provide a new and improved reducing gear which permits stepless, i.e., steady, speed adjustment to be particularly useful for and in dredge pump drive systems, overcoming the specific deficiencies outlined above.

It is a specific object of the present invention to provide a new, reducing gear with speed control to be interposed between a driven input shaft and an output shaft, such as is connected to a dredge pump.

In accordance with the preferred embodiment, it is suggested to provide a planetary gear between the input and output shafts as per the specific object, wherein the sun gear is mounted on the input shaft and the output shaft is connected to the spider and planet carrier. The internal ring gear is part of a ring which carries also an outer gear which, in turn, is driven via a transmission by a hydrostatic motor to superimpose supplemental rotation upon the output shaft. This transmission thus functions also as torque support for the ring gear of the planetary gear system. This transmission includes a gear on an intermediate shaft, which gear acts directly as torque support. This shaft, in turn, is connected through transmission means to the motor. The motor is (hydraulically) driven by an auxiliary hydraulic pump which, in turn, is driven via a transmission branching some torque from the input shaft. The first-mentioned transmission includes a speed-responsive brake, possibly also a speed-responsive disconnect clutch for separating the hydrostatic motor; and the latter is preferably additionally subject to braking in the case of pressure irregularities in the hydraulic pump-motor circuit.

The invention, thus, provides a new and improved speed-controlled reducing gear system for dredge pumps, which system is characterized by low losses since only a part of the power is branched off the high speed input and fed into the speed control loop which includes the auxiliary pump and a hydrostatic motor, whereby the amount of power branched off depends upon the need which, in turn, depends on the adjustment of the pump-motor circuit. On the other hand, the advantage of a rugged reducing gear is maintained.

DESCRIPTION OF THE DRAWINGS

While the specification concludes with claims, particularly pointing out and distinctly claiming the subject matter which is regarded as the invention, it is believed that the invention, the objects, and features of the invention, and further objects, features, and advantages thereof, will be better understood from the following description taken in connection with the accompanying drawings in which the FIGURE illustrates a cross section of a reducing gear in accordance with the preferred embodiment of the invention and constituting the preferred mode of practicing same.

Proceeding now to the detailed description of the drawings, reference numeral 7 refers to a drive shaft for a dredge pump (not shown), and reference numeral 3 refers to a shaft being driven by, possibly being, the output shaft of a motor (not shown). The FIGURE illustrates in particular a reducing gear as it is interposed between such a motor-driving shaft 3 at a relatively high speed and a pump to be driven at a slow speed. The reducing gear is contained in a housing 18; shafts 3 and 7 lead into that housing and are journalled to the housing wall as well as inside thereof by means of suitable bearings; housing 18 is provided with internal walls, wherever needed, to support the various bearings and components inside the housing.

The principal component of the reducing gear is a planetary gearing which includes a central or sun gear 22, several planet gears 21 being uniformly distributed about the sun gear and meshing therewith, and an internal ring gear 15 on which the planet gears revolve.

Gear 15 is an internal ring gear and is disposed on the inside of an annular member 6, constructed as a wheel or ring, and carrying also an external or outer gear 16. The sun gear 22 sits directly on input shaft 3 and is secured thereto. The planet gears 21 are journalled on a gear carrier or spider 19. The spider or planet carrier 19 is also journalled in the housing by means of two bearings. The carrier or spider, moreover, is connected to, or integral with, output shaft 7; the bearings for the spider are, thus, bearings for the output shaft.

The hollow wheel or ring 6 is connected to a rotational element 20 which is journalled for free rotation on shaft portions of spider 19. The outer gear 16 of ring 6 meshes with a gear 17 on an intermediate shaft 5, being journalled in housing 18 by means of two bearings. Gear 17 functions as torque support to hold ring 6 and internal gear 15 of the planetary gear system. Additionally, rotation of gear 17 imparts or superposes supplemental motion upon ring 6 to be added to, or subtracted from, the rotation imparted by the planetary gear as driven by shaft 3 upon shaft 7.

Shaft 5 carries another, relatively large gear 25 which meshes with a smaller gear 26 on a second intermediate shaft 13. Thus, gears 25 and 26 kinematically interconnect shafts 5 and 13; but the main purpose is to laterally displace shaft 13 more from input shaft 3. In principle, there is no reason for not combining shafts 5 and 13 into a single shaft.

Shaft 13 carries a number of components; on the right-hand side of the drawing, a brake 8 is shown, being mounted on shaft 13 for cooperating, when actuated, with stationary parts mounted onto housing 18. Still farther to the right and already outside of housing 18, a speed governor 12 is shown, being constructed as a centrifugal switch. A valve 11 is included in the governor for being opened when the speed of shaft 13 exceeds a preadjusted limit.

Shaft 13 carries on its left-hand end a clutch 10 by means of which a hydrostatic motor 4 can be connected to the shaft. Clutch 10 may be of the centrifugal type to self-disconnect when a limit speed is exceeded. A spring-loaded brake 9 is interposed between clutch 10 and motor 4. One can see that shaft 13 with appended gearing brakes and clutch establishes a transmission from motor 4, leading to (or even, including) shaft 5 and gear 17 to drive ring 6.

Motor 4 is a so-called constant motor whose speed can be adjusted by controlling the oil quantity fed to it. Reversal of the direction of oil flow permits and causes reversal of the direction of rotation.

An adjustable, auxiliary pump 1 provides the pressurized oil for motor 4 via a pair of conduits 29 and 30, passing through an oil-pressure-monitoring unit 31. The adjustment of pump 1 is an adjustment of a relative angle and direction to, thereby, meter quantity and direction of the oil flow into the conduit systems 29 and 30. The pump (1)-motor (4) system is known, per se; angle and direction of the adjustment of pump 1 for constant speed determine speed and direction of the rotation of motor 4.

Reference numeral 31 refers generally to a device for monitoring the pressure in conduits 29 and 30. A branch line 32 from that box 31 leads to brake 9, to turn the brake off under normal operating and pressure conditions, against the effect of a spring 33. The brake is, thus, responsive to the absence of adequate pressure in the pump-motor hydraulic circuit.

Pump 1 is driven via gear trains 23, 24, and 2, whereby gear 23 sits on input shaft 3, gear 24 is an intermediate gear, and gear 2 sits on the input and drive shaft for the auxiliary pump 1. Thus, some power is branched off the rotational input from shaft 3 to drive pump 1 which, in turn, drives or runs motor 4. The latter drives gear 16 via a transmission which includes shafts 13 and 5 and the several gears thereof, and which includes also clutch 10 as well as two brakes.

The drive shaft for pump 1 carries another, small, auxiliary pump 35. The system includes another circuit for pressure fluid, provided by an external source through a conduit 27 and connected to a conduit 14 which runs this pressure fluid (e.g., oil) into governor 12. As stated, valve 11 in governor 12 is opened when the rotational speed of shaft 13 exceeds a particular limit and permits oil to flow into a conduit 28 and to a valve 34, for operating the same.

Valve 34 is interposed in a conduit and fluid path 36, leading from the second auxiliary pump 35 to brake 8. Brake 8 is, thus, hydraulically operated and will cause an excessively fast running shaft 13 to slow down, or even to stop.

The device as described operates as follows, in a number of particular operating states and under particular conditions:

(A) Normal Operation.

Valve 11 blocks fluid flow to valve 34; brake 8 is thus off. Pressure is effective in line 32, and brake 9 is also off. Shaft 3 runs and drives shaft 7 at a reduced rate, via sun gear 22 and spider 19. Gear 17 holds ring 6 which, thus, provides torque support for the internal gear 15 of the planetary gear; gear 15 may remain at rest if gear 17 is not rotating.

The rotation of gear 17 depends upon the rotation, if any, of motor 4. Any rotation, including direction and speed, of motor 4 depends upon the adjusting position of pump 1 and, here particularly, the direction and angle of adjustment. Thus, upon adjusting pump 1 with respect to angle and direction, motor 4 will drive shaft 13 more or less fast and in one or the other direction; and that motion is transmitted upon ring 6. Thus, auxiliary motion is superimposed upon the planetary gear and is added to, or subtracted from, the reduced rotation shaft 7 receives from shaft 3. One can, thus, adjust the speed of pump shaft 7, stepless and over a particular range. This way, one can provide readily for the various operating states of the dredge pump, including particularly suction and sludge pumping for different soil conditions.

(B) Pump Interference.

It is assumed that the system runs, or is supposed to run, as per state (A); but an interfering condition arises, blocking the dredge pump. Thus, shaft 7 stops, and the planetary gear becomes a transmission and reducing gear in which sun gear 22 drives the nonrevolving planets which, in turn, drive ring 6, so that motor 4 is now driven. Since motor 4 is a driving unit, its speed would suddenly increase drastically. This undesired speed increase is detected by governor 12, causing valve 11 to open, so that valve 34 is actuated, and pressure from auxiliary pump 35 is applied to brake 8, so that shaft 13 is braked, possibly down to a complete stop. Shortly thereafter, of course, one has to stop the drive motor (prime mover) driving shaft 3, and/or an overload clutch may disconnect the blocked system from the prime mover.

As an added precaution, one may additionally cause valve 34 to operate in response to excess pressure in the hydraulic circuit between motor 4 and pump 1 (detection in box 31). Whenever the motor is being driven, it does, in fact, act as a pump, and pressure in circuits 29 and 30 will rise unduly. The detector in box 31, when detecting that pressure increase, can readily be used as a controller, to operate valve 34. This redundancy is particularly helpful, should the hydraulic system 27 and/or governor 12 with valve 11 fail in addition.

(C) Fluid Interference.

It is again assumed that the device is supposed to operate as per (A), but an interference may arise through failure, e.g., of and in the hydraulic circuit as between pump 1 and motor 4. Should motor 4 tend, for any reason, to increase its speed, governor 12 will cause brake 8 to operate exactly as described under (B). Additionally, or alternatively, the centrifugal clutch 10 will cause motor 4 to separate the motor from the shaft. The speeds for response of clutch 10 and governor 12 may be the same, or about the same, so that only one of them needs to act; the other serves as a backup in the case of failure.

Whenever hydraulic pressure loss occurs for any reason, and in any of the hydraulic control elements as described, clutch 10 will cause the requisite disconnect function, if and when needed. If pressure loss occurs particularly in the pump-motor circuit, pressure in line 32 will drop and spring 33 will actuate brake 9.

It should be mentioned that clutch 10 may be operated hydraulically to provide disconnection whenever the oil pressure drops. Also, brake 8 may be constructed to respond to pressure loss (rather than to applied pressure).

The invention is not limited to the embodiments described above; but all changes and modifications thereof, not constituting departures from the spirit and scope of the invention, are intended to be included.

I claim:

1. A reducing gear with supervisory and speed control systems, and being interposed between a driven input shaft and an output shaft, leading, for example, to a dredge pump, comprising:

a planetary gear with sun gear, spider, planet gears journalled on the spider, and an internal ring gear in a ring, the sun gear being connected to the driven input shaft, the spider being connected to the output shaft;

an intermediate shaft with a gear, said ring carrying an outer gear, meshing with the gear on the intermediate shaft;

a speed-controlled, hydrostatic motor;

transmission means for connecting the motor to the intermediate shaft, for driving the shaft at a speed depending upon the speed of the motor;

a flow-reversible, adjustable, auxiliary pump;

gear means, drivingly connecting said input shaft to said pump;

conduit means, interconnecting the pump and the motor so that the pump operates the motor; and brake means included in the transmission means and provided to prevent the planetary gear from driving the motor via the transmission means.

2. A gear and system as in claim 1, including means for operating a brake of the brake means in dependence upon a particular speed when occurring, or exceeded, in the transmission means.

3. A gear and system as in claim 1, wherein the transmission means includes a second intermediate shaft carrying a brake of the brake means, being connected to the motor and being geared to the first mentioned, intermediate shaft.

4. A gear and system as in claim 1, 2, or 3, said transmission means including a clutch for selectively disconnecting the motor from a driving portion of the transmission means, as connected to the first-mentioned intermediate shaft.

5. A gear and system as in claim 2 including a speed governor, further including an auxiliary hydraulic circuit connected to be controlled by the speed governor and provided for controlling the brake.

6. A gear and system as in claim 1, wherein the brake means includes a spring-loaded brake acting on the motor in response to pressure as provided by the auxiliary pump, to brake the motor when the pressure drops.

7. A gear and system as in claim 3, and including a speed governor and a hydraulic circuit connected to be controlled by the speed governor and controlling said brake.

* * * * *